United States Patent [19]

Chaize

[11] Patent Number: 5,009,544

[45] Date of Patent: Apr. 23, 1991

[54] METHOD AND MACHINE FOR WORKING AN AREA OF GROUND, IN PARTICULAR FOR SURFACING A ROAD

[76] Inventor: Alain Chaize, 3 rue Greneta, 75003 Paris, France

[21] Appl. No.: 394,414

[22] Filed: Aug. 14, 1989

[30] Foreign Application Priority Data

Aug. 18, 1988 [FR] France ..... 88 10998

[51] Int. Cl.[5] ..... E01C 19/22

[52] U.S. Cl. ..... 404/72; 404/84; 404/105; 404/118; 172/4.5; 37/DIG. 20

[58] Field of Search ..... 404/84, 85, 86, 101, 404/105, 72, 75, 118; 172/4.5, 779, 780; 37/108 A, DIG. 20; 425/63; 264/33

[56] References Cited

U.S. PATENT DOCUMENTS

| | | | |
|---|---|---|---|
| 2,393,954 | 2/1946 | Baker | 404/105 |
| 2,491,275 | 12/1949 | Millikin | 404/105 |
| 3,052,997 | 9/1952 | Holland | 172/4.5 |
| 3,210,710 | 10/1965 | Amos | 404/118 |
| 3,564,986 | 2/1971 | Burgin | 404/118 |
| 3,613,530 | 10/1971 | Hess . | |
| 3,618,484 | 11/1971 | Long | 404/84 |
| 4,045,893 | 9/1977 | Feinzilber et al. | 172/4.5 |
| 4,073,592 | 2/1978 | Godberson et al. | 404/105 |
| 4,678,364 | 7/1987 | Charonnat et al. | 404/105 |

FOREIGN PATENT DOCUMENTS

| | | |
|---|---|---|
| 1049413 | 12/1959 | Fed. Rep. of Germany . |
| 1584199 | 12/1969 | France . |
| 2220626 | 10/1974 | France . |
| 2270380 | 12/1975 | France . |
| 2578872 | 9/1986 | France . |
| 498981 | 12/1970 | Switzerland . |

OTHER PUBLICATIONS

"Les Machines A Coffrage Glissant Et L'Uni Des Chaussées En Béton", *Bulletin De Liaison Du Laboratoire Des Ponts Et Chasussees, No. 95, May-Jun. 1978, Ref. 2231, by M. Ray et al., pp. 99-132.*

*Primary Examiner*—Bruce M. Kisliuk

*Attorney, Agent, or Firm*—Young & Thompson

[57] ABSTRACT

A tool (23) for extruding a paved surface (39) is located behind tracks (2) and may thus have a width which is greater than the overall width perpendicular to the tracks. The tool is carried by a bridge frame (27) articulated on the frame (1), carried by the tracks, according to a transverse axis (X—X). At the rear, the bridge frame (27) rests on the freshly paved surface (39) via air cushions (32). A hauled rule (58) emits a ray (63) parallel to the surface (39) as detected by the rule. A detector (64) carried by the tool (23) and receiving the ray (63) detects the position in respect of height of the bed (23) relative to the surface (39). Jacks (38) correct the position in respect of height of the tool as a function of this detection. A ballast (42) is displaced automatically along the bridge frame (27) in order to adjust the pressure in the air cushions (32).

24 Claims, 3 Drawing Sheets

FIG_4
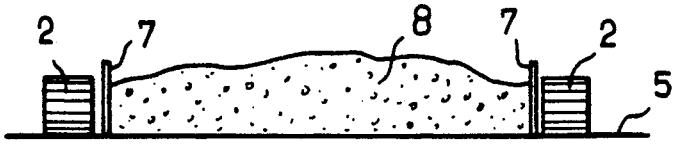
FIG_5
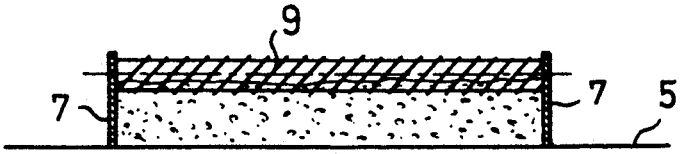
FIG_6
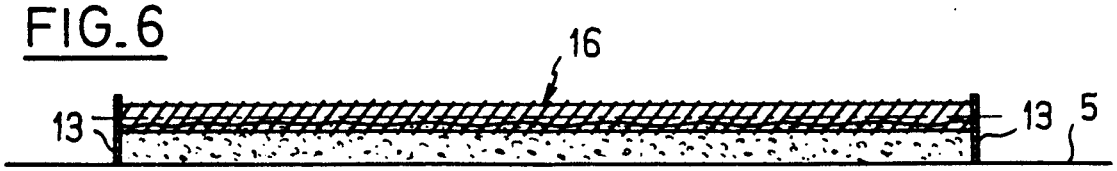
FIG_7
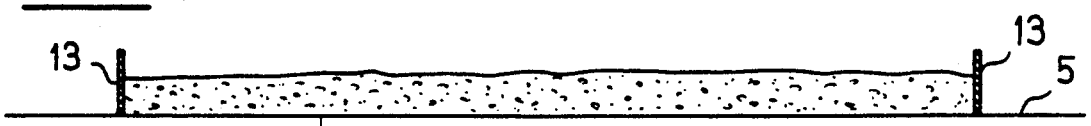
FIG_8
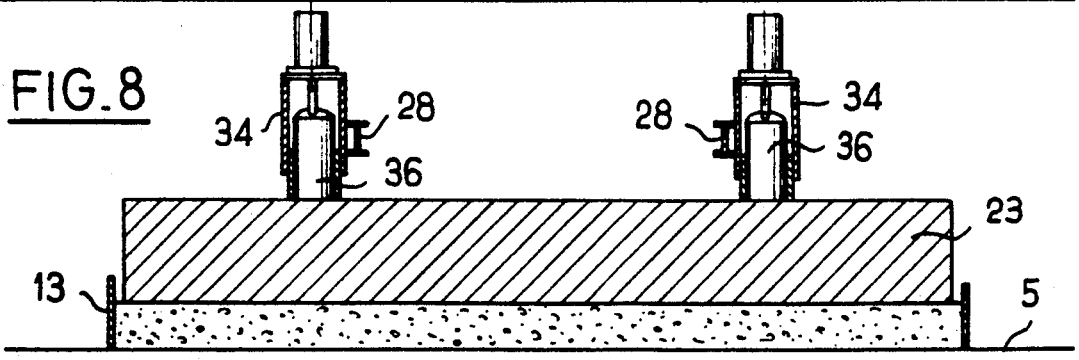
FIG_9
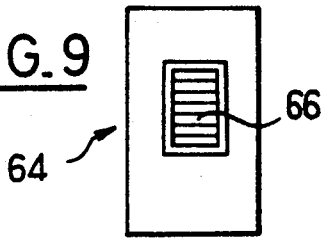
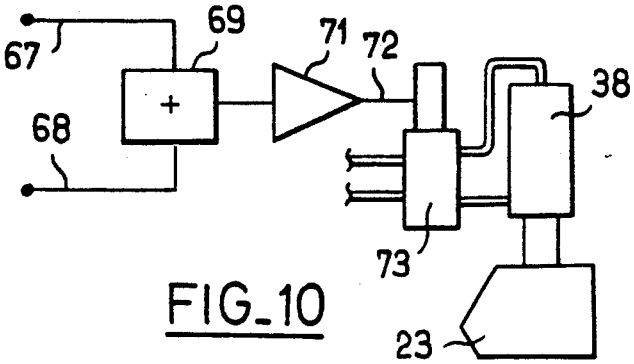
FIG_10

METHOD AND MACHINE FOR WORKING AN AREA OF GROUND, IN PARTICULAR FOR SURFACING A ROAD

The present invention relates to a method for working an area of ground, in particular for surfacing a road with asphalt concrete or cement concrete.

The present invention also relates to a machine designed for this purpose.

Sliding-form machines are known, such as those described, for example, by RAY and CHARONNAT on pages 98 to 132 of the Liaison Bulletin of the Highways Department Laboratory No. 95—May, June 1968, reference 2231. These machines are intended for surfacing a road with asphalt concrete or cement concrete. They comprise a frame which rests and advances on the unsurfaced ground by means of two or four tracks. The members for support on the ground have a transverse space between them in which the frame carries a sliding form, that is to say two lateral forms, forming with an upper extrusion bed, a tunnel through which the surfacing material is extruded.

On site, two wires, defining a reference area to which the area of the finished surface must be parallel, are stretched on either side of the path provided for the machine. The frame carries wire monitors, each of which detects the position of a point of the frame with respect to the reference area. The position in respect of height of various points of the frame in relation to the means for support on the ground is adjusted as a function of this detection, by means of jacks, in a direction such that the lower surface of the extrusion bed, whose path defines the profile of the road produced, is parallel to the reference area and at a specific distance from the latter.

It is essential that the road produced has as smooth a profile as possible. It is therefore important to minimize the influence of the movements of the frame on the extrusion bed when the frame is adjusted in respect of height relative to the reference area. It is for this reason that, in known machines, the extrusion tunnel is located between the means for support on the ground, in the vicinity of the center of gravity of the machine. In these conditions, the surface produced necessarily has a width which is smaller than the free width between the means for supporting on the ground, which are generally tracks.

CH-A-498,981, in particular, discloses a machine of the type indicated above, of the type with four tracks, the structure being articulated about a transverse horizontal axis positioned between the front tracks and the rear tracks. A front frame rests on the rough ground via the front tracks. A bridge frame is articulated on the frame about the transverse horizontal axis and rests on the rough ground via the rear tracks. Tools are mounted transversely under the bridge frame between the front tracks and the rear tracks. Various adjustment means 7, 26 are used to correctly position the tools in respect of height despite the unevenness of the rough ground. The rear support means rest on either side of the worked area produced. The working width of the machine is therefore less than its overall width. Finally, although it comprises an articulated bridge frame, this machine scarcely differs in principle from a rigid frame machine. Spurious movements may originate both from the front frame, which rests on the rough ground, and from the rear tracks which also rest on the rough ground.

In addition, DE-B-1,049,413 discloses a machine for depositing a constant layer of surfacing material, which machine consequently has no means for directly or indirectly adjusting the position of the tool with respect to a reference area. The machine comprises (FIGS. 3 and 4) a front frame resting on the rough ground and a bridge frame supporting a tool and whose rear end rests via rollers on the worked area whose width may therefore be greater than the width supporting the machine on the ground.

DE-B-1,049,413 emphasizes the disadvantages of such a machine which is described only in terms of the state of the art. As the document rightly explains, any defect in the worked area will produce a second similar defect when the rear support roller, passing over the defect, causes a spurious movement of the tool. This second defect produced by the tool will, in turn, be passed over by the roller, which will lead to the formation of a third defect, and so on.

In order to remedy this disadvantage, DE-B-1,049,413 proposes the production of the worked area in three parallel strips, the central strip being produced with a tool substantially located in the pitch axis of the front frame of the machine so as to minimize the pitch incidence of the machine over the position of this tool in the vertical plane. Provision is, moreover, made for the rear support roller of the bridge frame to roll over the central strip of the worked area, that is to say the strip which is least likely to present a defect. Moreover, two lateral tools are provided in an offset position towards the rear in order to produce two lateral surfacing strips on either side of the central strip. The bridge frame thus positions the two lateral tools independently of defects which the two lateral strips may present and, consequently, these two lateral strips 13 themselves have fewer defects.

This solution is not very satisfactory because it requires three tools, because it does not eliminate defects in the lateral strips of worked area and also because it necessarily involves the presence of longitudinal joins between the three strips.

Machines have also been designed in which the extrusion tunnel has a width greater than the free width between the tracks and in which it is disposed overhanging beyond the rear of the track. However, this solution does not make it possible to produce roads of excellent quality, each automatic positioning movement of the frame being transmitted, with amplification, to the extrusion bed.

The aim of the present invention is therefore to propose a method and a machine for producing an area of worked ground of very high quality over a width which may be markedly greater than the free width between the means, such as tracks, for support on the nonworked ground.

According to a first aspect of the invention, the method for working an area of ground in which a machine carrying a tool which is in contact with said area is displaced along the area to be worked while means at least indirectly supporting the tool are adjusted in respect of height so that the latter follows a path which is substantially independent of the unevenness of a nonworked region of the ground over which there progress means for support on the rough ground located upstream of a rear transverse end of the tool, the tool being supported, during working, under a bridge frame a front end of which is supported by the means for support on the rough ground via an articulation with an axis transverse to the median longitudinal plane of the machine, is defined in that a rear end of the bridge frame is caused to rest on the worked area under a pressure which is sufficiently low to avoid any significant deterioration of the worked area.

Given that, according to the invention, the tool is adjusted at least indirectly in respect of height to make its path substantially independent of the nonworked ground, the risk of seeing the appearance on the worked area of defects such as those cited in DE-B-1,049,413 is greatly reduced, and, above all, the probable amplitude of such a defect is also considerably reduced. Adjustment of the level filters the defects and allows, at most, only very attenuated remaining defects to pass. By virtue of the bridge frame, these disturbances arising at the level of the front frame reach the tool only when their amplitude has been substantially halved (effect of lever arms about an axis passing via the means for distributed support on the worked area). The actual risks of such a defect creating successive echoes, due to the means for distributed support passing over the worked ground, become negligible, in particular when bearing in mind the very low possible amplitude of these defects and the fact that the support is distributed.

The result obtained by virtue of the invention is better than that obtained with DE-B-1,049,413, because it eliminates both the risk of successive echoes due to a defect and the longitudinal joins between three strips of worked ground The result obtained according to the invention is also better than that obtained using the technique according to CH-A-498,981 since, according to the invention, the rear end of the bridge frame rests on the worked ground, which is very even, and not on the rough ground, which improves the stability of the path of the tool, and also because the working width permitted by the invention is markedly greater. Moreover, the invention does not require a suitable strip of nonworked ground to be disposed on either side of the road to be produced.

Moreover, it must be borne in mind that DE-B-1,049,413 strongly advised the person skilled in the art against providing a tool formed from a single support under a bridge frame, approximately half way along the latter, between a frame supporting the front end of the bridge frame, on the one hand, and means for distributed support on the worked ground supporting the rear end of the bridge frame, on the other hand.

According to a second aspect of the invention, the machine for working an area of ground, in particular for implementing the method according to the first aspect, comprising a frame resting in a movable manner on a nonworked region of the ground via means for support on the rough ground, a bridge frame, a front end of which is supported by the frame via an articulation with an axis transverse to the median longitudinal plane of the machine, and a rear end of which is equipped with means for movable support on the ground, a tool mounted under the bridge frame and comprising a rear transverse end located behind the means for support on the rough ground, and means for adjusting in respect of height means at least indirectly supporting the tool so that the latter follows a path which is substantially independent of the unevenness of said nonworked region of the ground, is defined in that the means for supporting the rear end of the bridge frame are means for movable and distributed support over the worked area.

Other features and advantages of the invention will also emerge from the following description.

In the appended drawings which are given by way of nonlimiting examples:

FIGS. 4 to 8 are diagrammatic sectional views along the planes IV—IV, V—V, VI—VI, VII—VII, VIII—VIII of FIG. 1, respectively;

FIG. 9 is a front view, on an enlarged scale, of a ray-receiving area mounted on the front face of the tool; and FIG. 10 is a block diagram of the means for controlling the position of the tool as a function of the signal for detecting the position of the tool.

Figure 1:
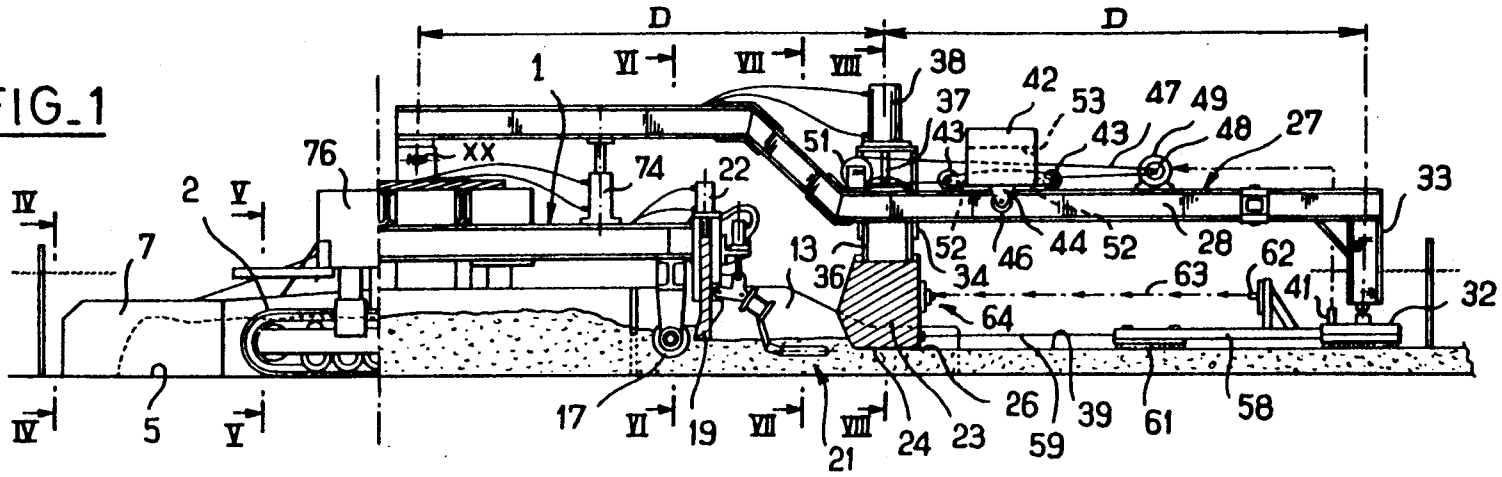
FIG. 1 is a view of a machine according to the invention, in lateral elevation and partially in section along the line I—I of FIG. 2.
Figure 3:
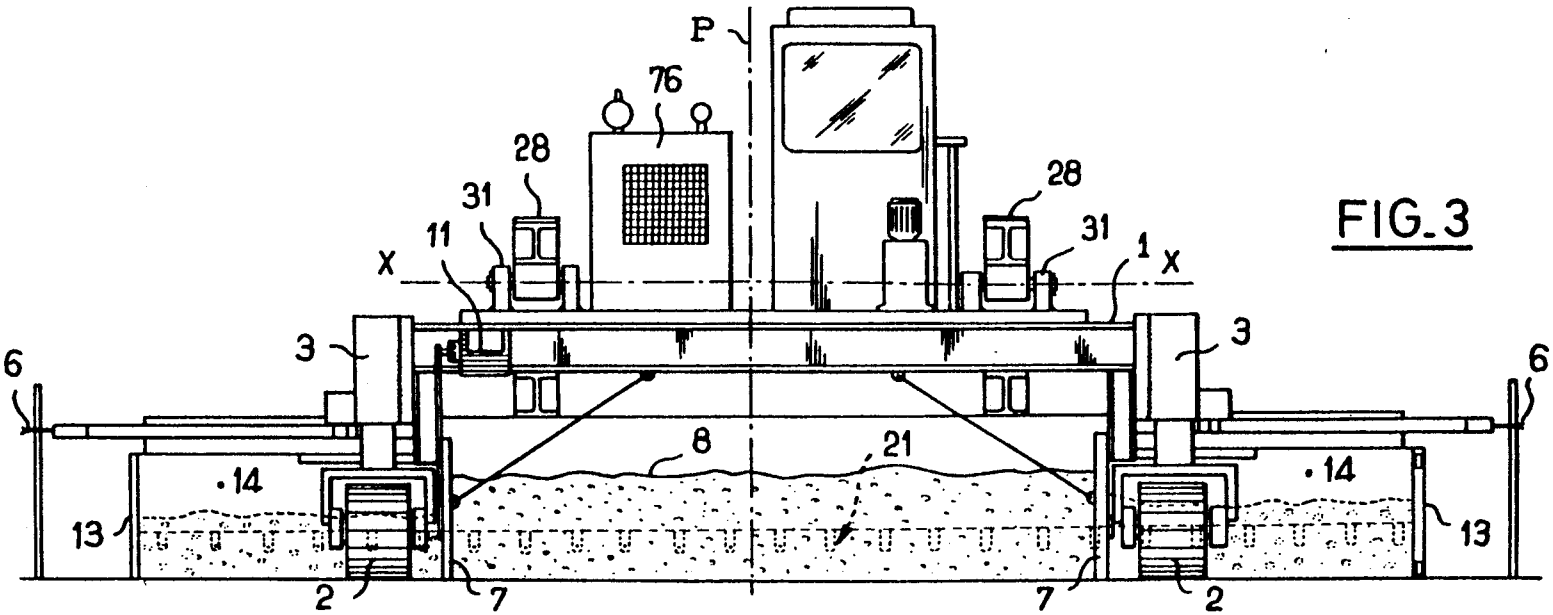
FIG. 3 is a front view of the machine of FIG. 1.
Figure 2:
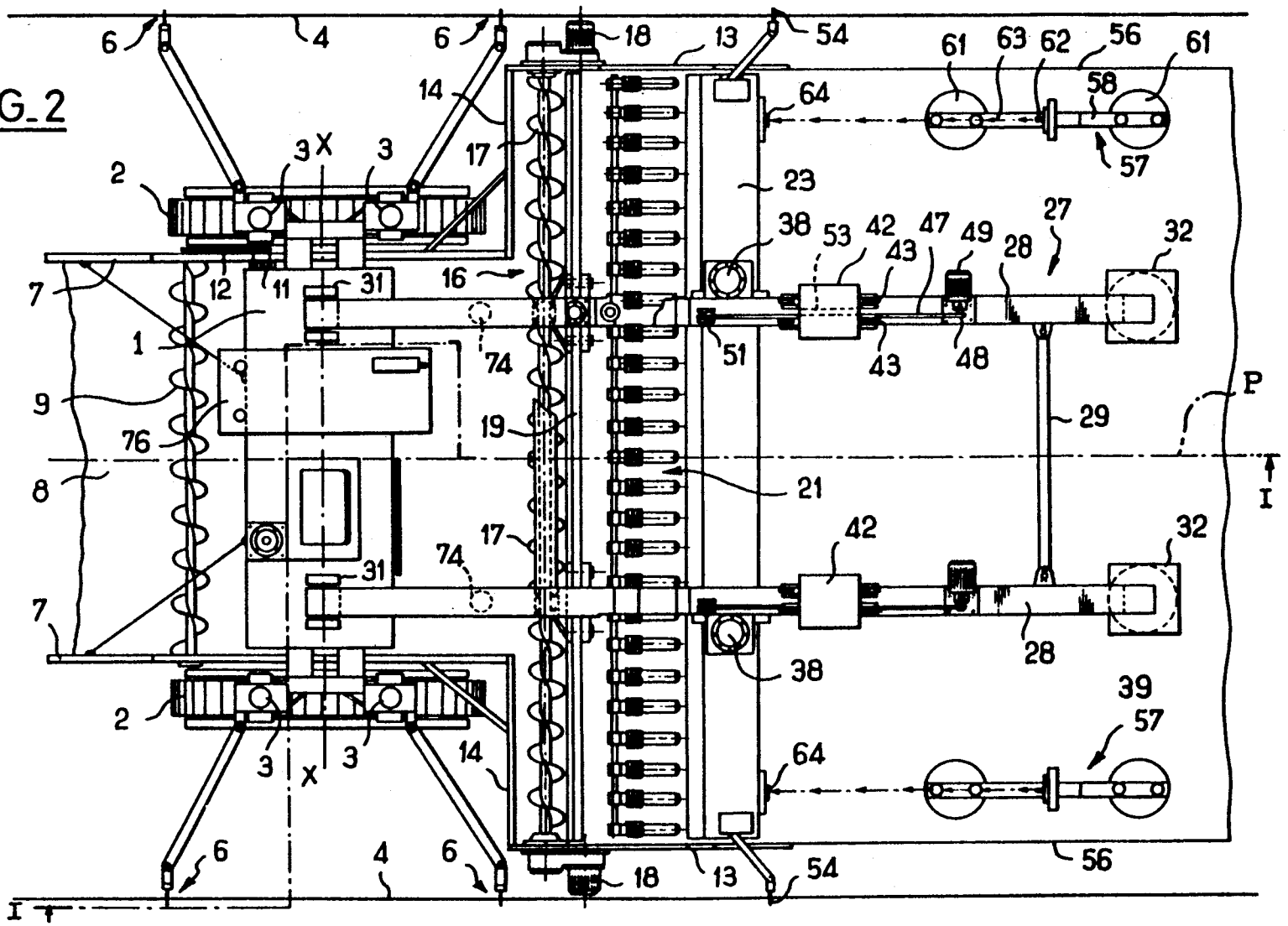
FIG. 2 is a diagrammatic plan view of the machine of FIG. 1.

In the example represented in FIGS. 1 to 3, the machine for surfacing a road with asphalt concrete or cement concrete comprises a frame 1 resting on the nonsurfaced ground 5 via two lateral drive tracks 2. The frame 1 is connected to the tracks 2 via four jacks 3 provided in order to adjust the position in respect of height of the frame 1 relative to the tracks 2 in order to compensate for unevenness encountered by the tracks 2 during their progress over the rough ground 5.

Rough ground is understood to mean the nonsurfaced ground or the ground which has not yet been surfaced by the machine.

Prior to setting the machine in operation, two wires 4, called "stretched wires", which together define a reference area to which the area of the surface to be produced must be parallel, are stretched longitudinally on either side of the area that the machine must surface. Each jack 3 is associated with a sensor 6 which follows the wire 4 located on the same side of the machine as the jack 3 in question and which transmits information relating to the position in respect of height of the frame 1 perpendicular to the jack 3 relative to said wire 4 to means for controlling the jack 3. These means for providing the frame 1 with a path which is as independent as possible of the unevenness of the rough ground are known per se and will thus not be described in greater detail.

The two tracks together define a free transverse distance in which the frame 1 carries, substantially in contact with the rough ground, two front lateral forms 7 (FIGS. 2 and 3) intended to receive between them, in front of the frame 1, from supply means such as trucks or conveyor belts, the concrete 8 intended to form the surface. Each of the front lateral forms 7 is adjacent to one of the tracks 2. A distribution screw 9 (FIG. 2) with a transverse horizontal axis driven by a motor 11 via a transmission means 12 is mounted so as to rotate between the front lateral forms 7. In a known manner, the rotation of the screw 9 about its axis causes the level of concrete 8 over the free width between the front forms 7 to be approximately even.

Behind the tracks 2, each front form 7 is connected to a rear lateral form 13 via a transverse form 14. The free distance between the rear lateral forms 13 is greater than the free distance between the tracks 2, and even greater than the overall width of the machine perpendicular to the tracks 2, excluding sensors 6. A rear distribution device 16, comprising two transverse screws 17 rotating in opposite directions and aligned with one another, extends between the rear lateral forms 13, just behind the transverse forms 14. Each of the screws 17 is driven by a respective motor 18 fixed to the respective lateral form 13.

Downstream of the screws 17, relative to the direction of flow of the concrete through the machine, is provided a transverse prelevelling bar 19, followed in a downstream direction by a vibrating device 21. As shown in FIG. 1, the prelevelling bar 19 is adjustable in respect of height by means of a jack 22. FIG. 1 also shows that the screws 17, the bar 19 and the vibrating device 21 are directly supported by the frame 1.

Downstream of the vibrator 21, therefore further back than the vibrator 21 relative to the means 2 for support on the rough ground (tracks), an extrusion bed 23 extends transversely between the rear lateral forms 13. Thus, the active lower surface 24 of the extrusion bed 23, and in particular its rear transverse edge 26, are behind the tracks 2 and extend over a width which is much greater than the free width transversely between the tracks 2.

In addition to the frame 1, the structure of the machine comprises a bridge frame 27 essentially comprising two longitudinal beams 28 disposed at an equal distance on either side of the median longitudinal plane P of the machine, and connected to one another, in the vicinity of their rear end, via a spacer 29 articulated on each end.

At their front end, the two beams 28 are articulated on the frame 1 according to a common axis X—X via two covers 31. The axis X—X is perpendicular to the plane P. The covers 31 are located on top of the frame 1 and the beams 28 extend, in their front region, above the frame 1.

The bridge frame 27 extends rearwards from its articulation via the covers 31 and is supported at its rear end via two air cushions 32 each mounted at a lower end of a leg 33 welded under the rear end of one of the beams 28. The air cushions 32 are supplied with compressed air by means which are not shown.

The length of each beam 28 is such that the cushions 32 are located behind the extrusion bed 23. Moreover, the distance between each cushion 32 and the median longitudinal plane P of the machine (FIG. 2) is less than the half-width of the extrusion bed 23 such that, during operation, the two air cushions 32 rest on the upper area 39 of the surface produced by the machine.

The extrusion bed 23 is supported by the bridge frame 27 with no other mechanical link with the frame 1. To this end, each beam 28 carries on its side opposite to the other beam 28 a tubular guide with a vertical axis 34 in which is engaged in a sliding manner a column 36 whose base is fixed rigidly to the upper face of the extrusion bed 23. The upper end of each column 36 is attached to the end of the movable rod 37 of a jack 38 for adjusting the extrusion bed 23 in respect of height.

As shown diagrammatically in FIG. 1, the bed 23 is substantially located at an equal distance D from a vertical plane passing through the axis X—X and from a vertical plane passing through the air cushions 32.

It is important that the air cushions 32 do not exert a pressure on the worked area 39 which is likely to reach or exceed the minimum pressure which would deform the worked area 39. However, it is also important for this pressure to be present. Zero pressure would mean that the reaction undergone by the extrusion bed 23, reaction directed vertically upwards, exceeds the forces of gravity being exerted on the bed 23. In other words, the bed 23 would be raised under the pressure of the concrete being exerted under it. Bearing in mind these two essential features, it has been determined according to the invention that the pressure exerted by the air cushions 32 on the area 39 should remain between approximately 100 and 500 g/cm$^2$.

The pressure exerted by the air cushions 32 on the area 39 does not depend solely on the particular constructional features of the machine. In fact, the vertical upwards reaction undergone by the extrusion bed 23 is a function, in particular, of the quality of concrete used. In addition, the pressure on the part of the air cushions 32 which can be supported by the concrete also depends on this quality. This is why means are provided for continuously adjusting the pressure exerted on the area 39 by the air cushions 32. To this end, each air cushion 32 is equipped with a pressure detector 41. In an air cushion, the pressure is a function of the load supported by the air cushion. For example, when the load increases, the air cushion approaches the ground, which reduces its peripheral leakage flow and increases the loss of load caused by this leakage. Consequently, the pressure increases until it balances the new load. The air cushion is then stabilised at this new height for which the pressure exerted by the compressed air inside its chamber balances the load to be supported.

Bearing in mind the above, another advantage of adjusting the pressure of the air cushions in the machine described will be understood: if the pressure in the air cushions is substantially constant, the height of the air cushions above the area 39 is substantially constant, and the spurious movements transmitted by the air cushions to the extrusion bed 23 are minimised.

According to the above explanations relating to 20 the air cushions in general, it will also be understood that, in order to adjust the pressure in the air cushions 32, it is necessary to act not on the supply pressure of the air cushions but on the load they support.

To this end, a movable ballast 42 is mounted in a displaceable manner along each of the beams 28. In practice, each ballast 42 consists of a slide rolling over the upper surface of the beam via small wheels 43. In addition, the ballast 42 carries, on each side of the associated beam 28, a lateral guide lug 44, which, in turn, carries a small retention wheel 46 bearing under the upper wing of the beam 28 which, in the example, is a standard beam. A belt 47 surrounding an output pulley 48 of a servomotor 49 and a return pulley 51 is attached via its two ends 52 to two opposite faces of the ballast 42. The side of the belt 47 which is continuous between the pulleys 49 and 51 (the upper side in FIG. 1) passes through a conduit 53 made through the ballast 42. The signals supplied by the detector 41 of each air cushion 32 is sent to the motor 49 carried by the same beam 28 so that the latter controls the corresponding displacement of the ballast 42 in the direction tending to restore the pressure in the cushion 32 to a predetermined reference value.

The machine according to the invention also comprises means for detecting the position of the tool relative to at least one reference area.

In the example represented, these means comprise sensors 54 (FIG. 2), each interacting with one of the wires 4, the reference area thus being that defined by the wires 4 which, on either side of the road to be produced, are disposed at an equal height above the theoretical plane of the area 39.

The area 39 of the road produced and, more particularly, two regions of this area located in the vicinity of the lateral edges 56 of the area 39 and at a certain distance behind the extrusion bed 23, for example three meters behind the bed 23, are also used as a reference area. 20 In order to carry out this detection, the machine according to the invention comprises two devices 57, called "hauled rules", comprising a rule 58, one front end of which is linked to the rear face of the extrusion bed via a traction cable 59 (FIG. 1) parallel to the area 39. Each end of the rule 58 rests on the area 39 via a shoe 61. Each rule 58 carries an emitter 62 of an electromagnetic ray 63, which may be a UV, X or laser ray. The position of each detector 62 is adjusted accurately so that the ray 63 is emitted parallel to the area 39 as detected by the two associated shoes 61, and at a well-specified height above the area 39 thus detected.

The rear face of the extrusion bed 23 carries, opposite each emitter 62, a detector 64 adjacent to one of the lateral ends of the bed. As represented in FIG. 9, the sensitive surface 66 of the detector 64 is subdivided into vertically graduated zones. These are, for example, vertically graduated photoelectric cells. Each detector 64 emits an output signal consisting, for example, of a current whose intensity is a function of the height of the photoelectric cell which is struck by the ray 63.

On each side of the plane P, the signals emitted by the detector 64 and by the sensor 54, which itself also supplies a current whose intensity is a function of the relative height of the corresponding end of the bed 23 relative to the adjacent wire 4, are used to adjust the position in respect of height of said end of the bed 23, by virtue of the jack 38 located on the same side of the plane P.

In practice, as shown in FIG. 10, the signal originating from the output 67 associated with the sensor 54 and the signal originating from the output 68 of the detector 64 located on the same side of the plane P are added together with, if appropriate, weighting in an adder circuit 69. The output signal is amplified by means of an amplifier 71. The output 72 of the amplifier 71 is used to control a proportional solenoid valve 73 controlling, in turn, the supply of the jack 38 located on the same side of the plane P.

The signals present at the outputs 67 and 68 are added together algebraically by the circuit 69.

This means that:

if the sensor 54 detects, for the corresponding end of the bed 23, a height which is insufficient relative to the wire 4 and if the detector 64 also detects a height which is insufficient relative to the rule 58, the two signals are added together to control a significant flow towards the corresponding jack 38, in the direction of the rise of the bed 23;

the same applies if the sensor 54 and the detector 64 detect an excessive height of the bed 23 relative to the wires 4 and relative to the rule 58, respectively; however, the jack 38 is then controlled in the descent direction;

if the detections of the sensor 54 and of the detector 64 are in conflict (for example, if the detector 64 detects an excessive height of the tool 23 relative to the rule 58 whereas the sensor 54 detects an insufficient height relative to the wire 4), the signal supplied by the detector 64 is subtracted from that supplied by the sensor 54 in order to limit the flow sent to the jack 38 in the direction specified by the sensor 54.

In practice, the detection performed with reference to the area 39 acts as a damper with respect to the corrections controlled with reference to the wires 4. For example, if a section of road has been produced slightly below the theoretical level, the movement of the tool 23 in order to correct its position will very rapidly cause an excess height signal on the part of the detectors 64 which refer to the section which is too low, which signal will slow down the subsequent rise of the tool 23 controlled by the sensors 54.

The bridge frame 27 is designed to allow its two beams 28 to pivot independently of one another about the axis X—X in a certain relative angular deflection of the order of, for example, approximately 2 cm perpendicular to the extrusion bed 23. This is permitted, in particular, by the articulated mounting of the spacer 29. To the same end, the columns 36 have a slight lateral play in the guides 34. This limited independence of the beams 28 with respect to one another makes it possible to independently adjust the pressure in each cushion 32 and the height of each end of the tool 23.

The machine also comprises, behind the axis of articulation X—X, two jacks 74 which are each inserted between the frame 1 and the relevant beam 28. The jacks 74 are provided in order to support the bridge frame 27 without the latter resting on its air cushions 32. This may be necessary when work begins, when there is still not a sufficient area 39 behind the machine. This may also be necessary when, following a breakdown, for example, the pressure in the air cushions 32 is insufficient to support the bridge frame 27. In this case, the jacks 74 are automatically put into operation in order to avoid damaging the area 39. Finally, the jacks 74 are used during transportation of the machine.

During operation, the concrete which has collected between the front lateral forms 7 (FIG. 4) is distributed by the screw 9 (FIG. 5), then by the distributors 16 up to the rear lateral forms 13 (FIG. 6), prelevelled by the bar 19, vibrated (FIG. 7) and then finally levelled by the extrusion bed 23 (FIG. 8) which forms, with the lateral forms 13, a movable extrusion tunnel.

In order for this extrusion to take place, a motor 76 of the engine, mounted on the frame 1, drives the tracks 2. At the same time, the frame 1 is automatically positioned in respect of height by virtue of the sensors 6 and the jacks 3.

The extrusion bed 23 is located halfway along between the axis X—X and the air cushions 32. Since it is carried by the frame 1 which is stabilised in respect of height, the axis X—X undergoes only slight vertical movements, on the part of the frame 1, which it has not been possible to filter using the automatic positioning device 3, 4, 6. The pitch movements of the frame 1 are filtered by the articulation X—X and are thus not transmitted in the form of amplified vertical oscillations to the tool 23.

At its rear end, the frame 27 rests on the worked area 39. The only oscillations to which this end of the bridge frame may be subjected are due to possible defects in the area 39 and to possible vertical movements of the air cushions 32 relative to the area 39. These two types of disturbances are of very low amplitude. The tool 23 is thus suspended halfway along between two support lines (articulation X—X and air cushion 32), neither of which is exposed to considerable disturbances. Moreover, each disturbance is transmitted to the tool 23 at half amplitude only.

Moreover, any error in the position of the tool 23 is detected by the sensors 54 and/or by the detectors 64 and the position of the tool is corrected by virtue of the jacks 38. The smooth quality of the worked area 39 is further improved which, in turn, improves the quality of the support obtained for the bridge frame 27 by the air cushions 32.

Of course, the invention is not limited to the examples described and represented.

The invention could be applied to other types of tool, for example face mills.

It is not essential to detect the position of the tool and to remedy the residual defects of its positioning. An already satisfactory smooth quality is obtained if the tool is, during working, fixed to the bridge frame, it being possible, however, for the tool to be adjusted in respect of height in order to permit the production of surfaces of various thicknesses.

The adjustment of the tool in respect of height could be performed by adjusting the bridge frame 27 in respect of height relative to the air cushions 32 or relative to the frame 1 (adjustment in respect of height of the axis X—X).

It is also possible for the frame to rest on the tracks 2 without a means for automatic positioning in respect of height, the only detection of position being made on the tool, the tool being automatically positioned with reference to the references constituted by the wires 4 and/or by the rays 63.

It would also be possible for only the frame 1 to comprise detectors such as the sensors 6, but for the frame 1 not to be automatically positioned in respect of height relative to the tracks 2, the data originating from the sensors being used to automatically position the tool, for example with the aid of the jacks 38.

Provision may be made, for supporting the bridge frame on the worked area, for shoes, one or more rolling members with a large contact surface area (low-pressure tires), and the like, instead of air cushions.

I claim:

1. A method for working an area of ground, in which a machine carrying a tool (23) which is in contact with said area is displaced along the area to be worked while means (3, 38) at least indirectly supporting the tool (23) are adjusted in respect of height so that said tool follows a path which is substantially independent of the unevenness of a nonworked region (5) of the ground over which there progress means (2) for supporting said machine on rough ground located forwardly of a rear transverse end (26) of the tool (23), the tool being supported, during working, under a bridge frame, one front end of which is supported by the means (2) for supporting said machine on rough ground via an articulation (31) with an axis (X—X) transverse to the median longitudinal plane (P) of the machine, wherein a rear end of the bridge frame (27) is caused to rest on the worked area (39) under a pressure which is sufficiently low to avoid any significant deterioration of the worked surface (37), and wherein said pressure is adjusted by displacing a ballast (42) along the bridge frame (27).

2. The method as claimed in claim 1, wherein the pressure is detected and the position of the ballast (42) is continuously adjusted so as to maintain said pressure constant.

3. The method as claimed in claim 2, wherein the rear end of the bridge frame is caused to rest on the worked area (39) by means of at least one air cushion (32), and in order to detect said pressure, a pressure prevailing in the air cushion (32) is detected.

4. The method as claimed in claim 1, further comprising:

continuously height-adjusting with respect to a reference surface a frame (1) carrying the articulation (31) and to which are connected the means (2) for supporting the machine on rough ground, and continuously height-adjusting the tool (23) with respect to the reference surface.

5. The method as claimed in claim 4, wherein the position in respect of height of the tool (23) relative to the bridge frame (27) is adjusted.

6. The method as claimed in claim 4, wherein the reference surface is defined by means of wires (4) stationarily positioned on either longitudinal side of the path of the machine, and wherein sensors (54) linked to the tool (23) are caused to interact with these wires (4).

7. A method for working an area of ground, in which a machine carrying a tool (23) which is in contact with said area is displaced along the area to be worked while means (3, 38) at least indirectly supporting the tool (23) are adjusted in respect of height so that said tool follows a path which is substantially independent of the unevenness of a nonworked region (5) of the ground over which there progress means (2) for supporting the machine on rough ground which are located forwardly of a rear transverse end (26) of the tool (23), the tool being supported, during working, under a bridge frame one front end of which is supported by the means (2) for supporting the machine on rough ground via an articulation (31) with an axis (X—X) transverse to the median longitudinal plane (P) of the machine, wherein a rear end of the bridge frame (27) is caused to rest on the worked area (39) under a pressure which is sufficiently low to avoid any significant deterioration of the worked surface (39), and wherein said pressure is continuously detected and adjusted to maintain said pressure substantially constant.

8. The method as claimed in claim 7, wherein said pressure is adjusted by continuously adjusting a position of a ballast (42) along the bridge frame (27).

9. The method as claimed in claim 7, wherein the rear end of the bridge frame is caused to rest on the worked area (39) by means of at least one air-cushion (32), and in order to detect said pressure, a pressure prevailing in the air-cushion (32) is detected.

10. The method as claimed in claim 7, further comprising:

continuously height-adjusting with respect to a reference surface a frame (1) carrying the articulation (31) and to which are connected the means (2) for supporting the machine on rough ground, and continuously height-adjusting the tool with respect to the reference surface.

11. The method as claimed in claim 10, wherein the position in respect of height of the tool (23) relative to the bridge frame (27) is adjusted.

12. The method as claimed in claim 10, wherein the reference surface is defined by means of wires (4) stationarily positioned on either longitudinal side of the path of the machine, and wherein sensors (54) linked to the tool (23) are caused to interact with said wires (4).

13. A machine for working an area of ground, comprising a frame (1), resting in a movable manner on a nonworked region of the ground (5) via means (2) for supporting the machine on rough ground, a bridge frame (27), a front end of which is supported by the frame (1) via an articulation (31) with an axis (X—X) transverse to the median longitudinal plane (P) of the machine, and a rear end of which is equipped with means (32) for movable and distributed support over a worked area of the ground, a tool (23) mounted under the bridge frame (27) and comprising a rear transverse end (26) located behind the means for supporting the machine on rough ground, height-adjustment means (33, 38) for height-adjusting means (3, 36) at least indirectly supporting the tool (23) so that said tool follows a path which is substantially independent of the unevenness of said nonworked region of the ground (5), said machine comprising first detection means (6) for detecting position of the frame with respect to a respective surface and second detection means (54, 64) for detecting position of the tool (23) relative to a reference surface independently of said position of the frame, the first detection means supplying a signal for controlling a part (3) of the height-adjustment means which is interposed between the means for supporting the machine on rough ground (2) and the frame (1), and the second detection means supplying a signal for controlling another part (36) of the height-adjustment means which is operatively interposed on the bridge-frame between the articulation (31) and the tool (23).

14. The machine as claimed in claim 13, wherein the detection means comprise sensors (54) intended to monitor references (4) located in a stationary manner longitudinally on either side of the area to be worked.

15. The machine as claimed in claim 13, wherein the detection means comprise means (57, 64) for detecting the position of the tool (23) relative to a region of the worked area (39) located at a distance behind the tool (23).

16. The machine as claimed in claim 15, wherein the means for detecting the position of the tool (23) relative to a region of the worked area (39) comprise a means (57) hauled by the machine in contact with said region of the worked area (39), and means (62, 64) for detecting the relative position of the tool (23) relative to the hauled means (57).

17. The machine as claimed in claim 16, wherein the means for detecting the relative position comprise an emitter (62) of rays (63) carried by the hauled means (57), and a detecting surface (66) carried by the tool (23) and sensitive to the position in respect of height where the rays (63) strike it.

18. The machine as claimed in claim 13, wherein said other part of the height-adjustment means comprises means for adjusting the position of the tool (23) relative to the bridge frame (27).

19. A machine for working an area of ground, comprising a frame (1), resting in a movable manner on a nonworked region of the ground (5) via means (2) for supporting the machine on rough ground, a bridge frame (27), a front end of which is supported by the frame (1) via an articulation (31) with an axis (X—X) transverse to the median longitudinal plane (P) of the machine, and a rear end of which is equipped with at least one air-cushion (32) for movable and distributed support over a worked area of the ground, a tool (23) mounted under the bridge frame (27) and comprising a rear transverse end (26) located behind the means for supporting the machine on rough ground, height-adjustment means (33, 38) for height-adjusting means (3, 36) at least indirectly supporting the tool (23) so that said tool follows a path which is substantially independent of the unevenness of said nonworked region of the ground (5).

20. A machine according to claim 19, further comprising means for detecting the pressure prevailing in the air-cushion, and means responsive to the pressure prevailing in the air-cushion for continuously adjusting the pressure exerted on the worked area (39) by the air-cushion.

21. The machine for working an area of ground as claimed in claim 20, wherein the means for continuously adjusting the pressure comprise a ballast (42) which is movable along the bridge frame (27).

22. A machine for working an area of ground, comprising a frame (1), resting in a movable manner on a nonworked region of the ground (5) via means (2) for supporting the machine on rough ground, a bridge frame (27), a front end of which is supported by the frame (1) via an articulation (31) with an axis (X—X) transverse to the median longitudinal plane (P) of the machine, and a rear end of which is equipped with means (32) for movable and distributed support over a worked area of the ground, a tool (23) mounted under the bridge frame (27) and comprising a rear transverse end (26) located behind the means for supporting the machine on rough ground, height-adjustment means (33, 38) for height-adjusting means (3, 36) at least indirectly supporting the tool (23) so that said tool follows a path which is substantially independent of the unevenness of said nonworked region of the ground (5), wherein the machine comprises means for detecting the pressure exerted by the means for movable and distributed support on the worked area and means for continuously adjusting said pressure to maintain it substantially constant.

23. The machine for working an area of ground as claimed in claim 22, wherein the means for continuously adjusting the pressure comprise a ballast (42) which is movable along the bridge frame (27).

24. A machine for working an area of ground, comprising a frame (1), resting in a movable manner on a nonworked region of the ground (5) via means (2) for supporting the machine on rough ground, a bridge frame (27), a front end of which is supported by the frame (1) via an articulation (31) with an axis (X—X) transverse to the median longitudinal plane (P) of the machine, and a rear end of which is equipped with means (32) for movable and distributed support over a worked area of the ground, a tool (23) mounted under the bridge frame (27) and comprising a rear transverse end (26) located behind the means for supporting the machine on rough ground, height-adjustment means (33, 38) for height-adjusting means (3, 36) at least indirectly supporting the tool (23) so that said tool follows a path which is substantially independent of the unevenness of said nonworked region of the ground (5), wherein the machine comprises a ballast which is displaceable along the bridge frame for adjusting the pressure exerted on the worked area by the means for movable and distributed support.

* * * * *